US005353534A

United States Patent [19]

Fassauer et al.

[11] Patent Number: 5,353,534

[45] Date of Patent: Oct. 11, 1994

[54] DEVICE FOR HOLDING A VARIABLE NUMBER OF REAR-ILLUMINATED ADVERTISEMENT CARRIERS FORMED OF POSTER-LIKE BLANKS

[76] Inventors: Angelika Fassauer; Peter Haluszka, both of An der Grenzkehre 10, DE - 2105 Seevetal 2, Fed. Rep. of Germany

[21] Appl. No.: 860,138

[22] Filed: Mar. 30, 1992

Related U.S. Application Data

[63] Continuation-in-part of Ser. No. 700,129, Jul. 19, 1991, abandoned.

[30] Foreign Application Priority Data

Sep. 29, 1989 [DE] Fed. Rep. of Germany ... 8911618[U]
Nov. 4, 1989 [EP] European Pat. Off. ..... 89120448.9
Sep. 11, 1991 [DE] Fed. Rep. of Germany ... 9111283[U]

[51] Int. Cl.[5] ..... G09F 11/12
[52] U.S. Cl. ..... 40/524; 40/537
[58] Field of Search ..... 40/524, 525, 537, 661, 40/655, 605, 644, 405

[56] References Cited

U.S. PATENT DOCUMENTS

| | | | |
|---|---|---|---|
| 899,977 | 9/1908 | Hendrick | 40/525 |
| 1,232,898 | 7/1917 | Dawson | 40/537 |
| 1,785,442 | 12/1930 | Fisher et al. | 40/525 |
| 3,826,026 | 7/1974 | Bevan | 40/644 |
| 4,201,002 | 5/1980 | Barton | 40/524 |
| 5,090,145 | 2/1992 | Chiang et al. | 40/605 |

FOREIGN PATENT DOCUMENTS 3725262 9/1989 Fed. Rep. of Germany .

*Primary Examiner*—Peter R. Brown
*Assistant Examiner*—J. Bonifanti
*Attorney, Agent, or Firm*—Sixbey, Friedman, Leedom & Ferguson

[57] ABSTRACT

A device for holding a variable number of rear-illuminated advertisement carriers formed of a poster-like blanks. Each advertisement carrier is mounted in a pocket that is open on one side and formed of a transparent flexible sheet material. The pockets can be positioned from a rear chamber to a visible front area by a drive device and then returned to the chamber. The pockets are connected into a disengageable chain of pockets that is contacted and driven by motor driven gears, belts or the like.

39 Claims, 13 Drawing Sheets

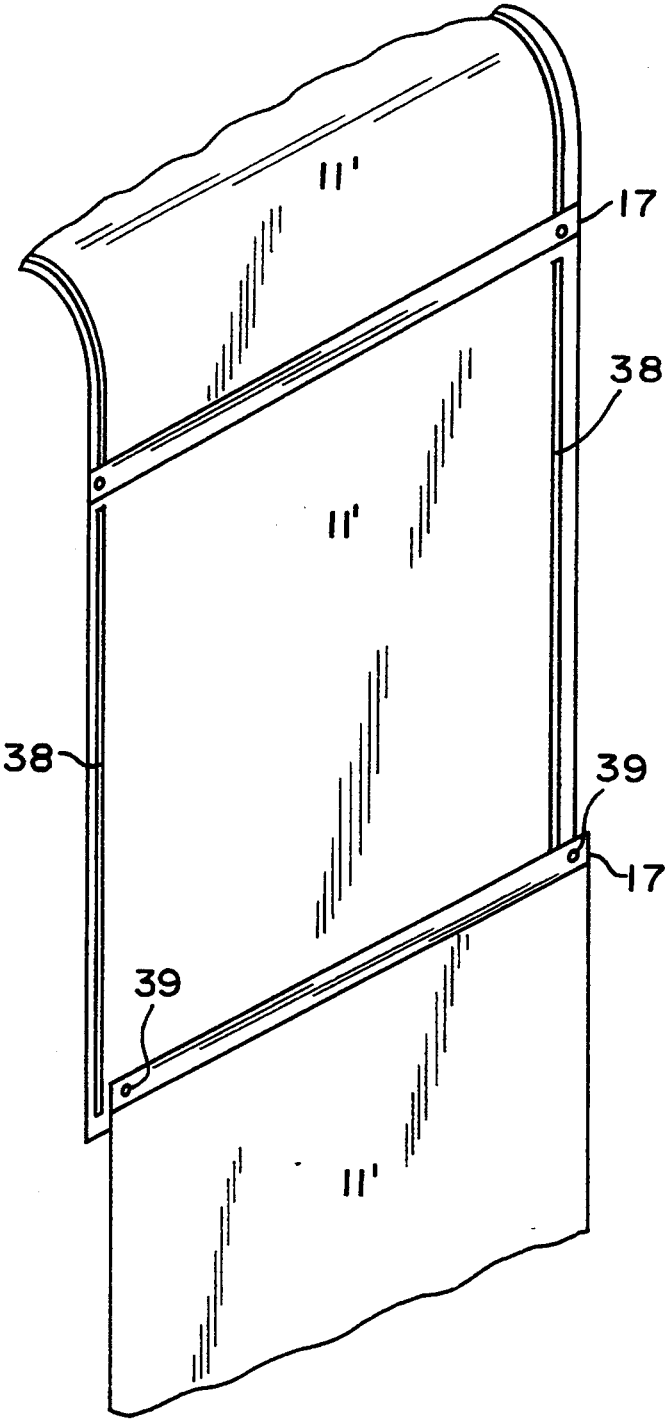
FIG. 7a
FIG. 7b
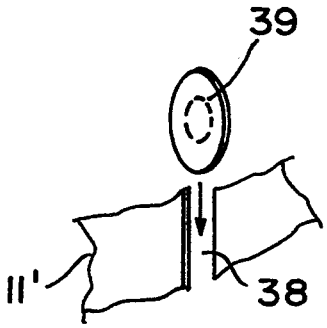
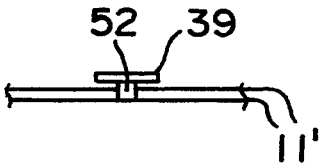
FIG. 7c

FIG. 9a
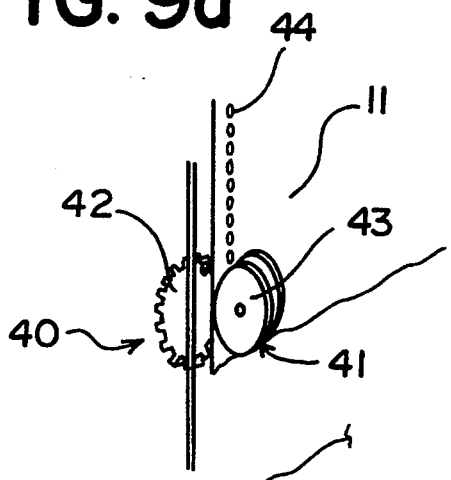
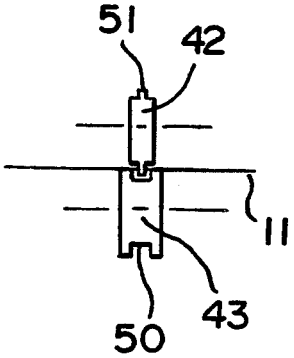
FIG. 9b
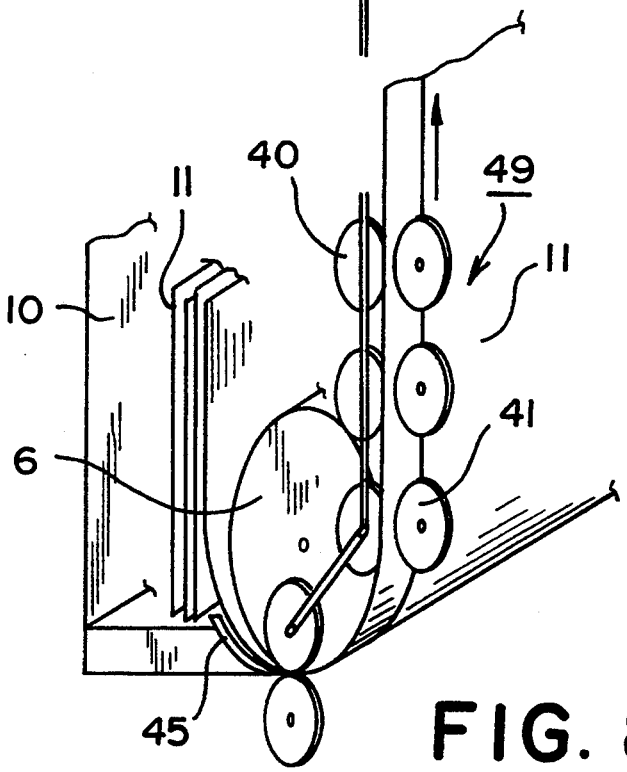
FIG. 8

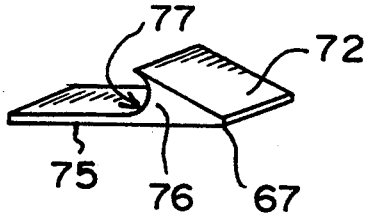
FIG. 14
FIG. 15
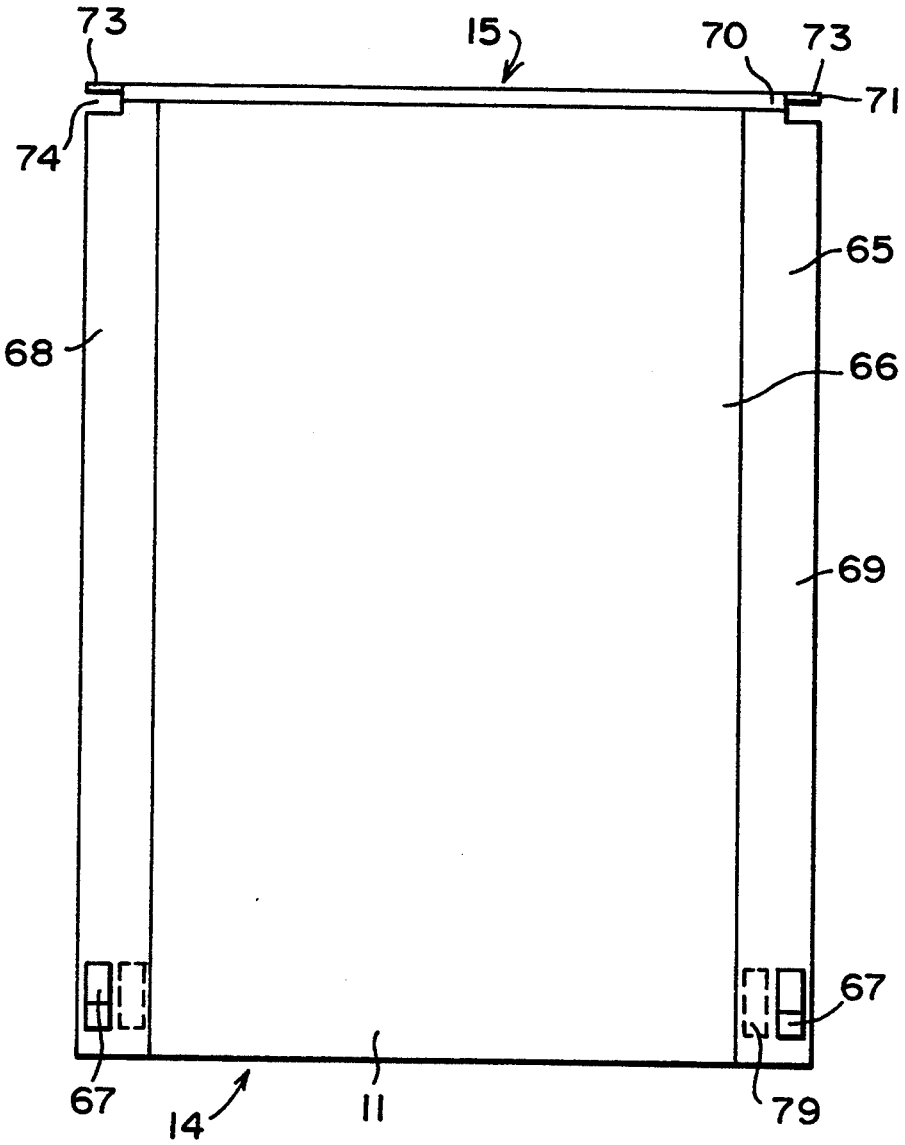
FIG. 16
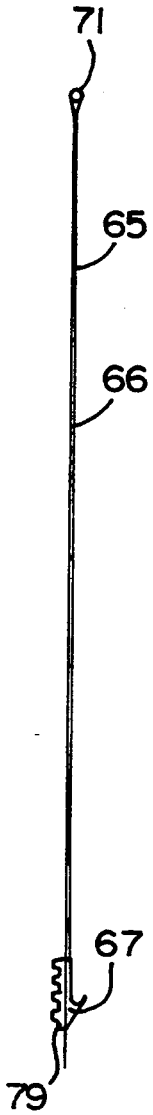

DEVICE FOR HOLDING A VARIABLE NUMBER OF REAR-ILLUMINATED ADVERTISEMENT CARRIERS FORMED OF POSTER-LIKE BLANKS

CROSS-REFERENCE TO RELATED APPLICATION

This application is a continuation-in-part of U.S. patent application Ser. No. 700,129, filed Jul. 9, 1991 now abandoned.

BACKGROUND OF THE INVENTION

The invention concerns a device for holding a variable number of rear-illuminated advertisement carriers formed of a poster-like blanks.

Known devices of the generic type consist of a housing, in which the illumination device is placed and on whose visible side a holder is provided to receive the advertisement carrier. The advertisement carrier can, e.g., consist of a poster-like blank made of paper designed as a poster. The disadvantage of these known devices is that only one advertisement carrier can be presented to the observer. If another advertisement carrier is to be seen on the visible side, a change of the advertisement carrier contained in the housing is necessary.

SUMMARY OF THE INVENTION

The primary object of the present invention is, therefore, is to design a device of the initially described type so that a change of the advertisement carriers that is viewable can be made simply and safely without changing the advertisement carriers in the housing of the device.

This object is achieved according to the invention by a device comprising two guide rollers spaced at a distance from one another, an illumination device disposed between the guide rollers and being formed between a front transparent guide wall and a rear dividing wall, a chamber for receiving advertisement carriers that is located behind said rear dividing wall, and a drive device for removing an advertisement carrier from said chamber and positioning it in front of said guide wall; wherein a slot-like intake opening and slot-like outlet opening extend across the width of the chamber in an upper and a lower area in proximity to a respectively one of the guide rollers; and wherein a pocket is provided in which a respective advertisement carrier is mounted, each pocket being formed of a transparent flexible sheet having an opening on one side and stiffening strips on opposite end sections of the flexible sheet.

The device according to the invention makes it possible, depending on the depth of the chamber for receiving the advertisement carriers, to convey any number of the carriers successively into the visible field by using an endless strip comprised of individual segments. Small outside dimensions of the housing of the device can be achieved. Changing of the individual advertisement carriers is no problem because of the configuration of the pockets receiving them. For conveying the pockets with an advertisement carrier a drive device can be selected which requires a small expenditure. Thus, a device is provided by the invention has an economical construction by which advertisement carriers with different advertising messages can be successively brought into the visible field at preset intervals.

A significant advantage of the drive device according to a special embodiment of the invention is the fact that toothed belts are furnished which have teeth at a narrow distance between one another. Therefore any tooth of the toothed belt is able to take over the transport of an advertisement carrier. There is no defined point at the toothed belt for taking over the transport. Therefore the toothed belts may be of undefined length. Decisive is only the right position of the drive shaft for the driven gears.

According to a further embodiment of the invention, it is possible to decrease the number of wearing parts of the device if the toothed belts for actuation are arranged at the backside of each pocket of an advertisement carrier. In this case, the toothed belts are made of toothed belt-strips. This device must be started manually however. The first pocket must be put on the gears. After rotation of the drive shaft by the driving motor the pockets within the device shape an endless loop automatically.

The invention is explained in greater detail below by embodiments of the device according to the invention in conjunction with the accompanying drawings.

BRIEF DESCRIPTION OF THE DRAWINGS

FIGS. 2 to 10 show perspective detail views of embodiments of the advertisement carrier as well as views of details thereof;

FIG. 14 an interlacing hook for connection of two advertisement carrier in a perspective view;

FIGS. 15 & 16 show a pocket of an advertisement carrier in a front view and a side view, respectively.

DETAILED DESCRIPTION OF THE PREFERRED EMBODIMENTS

Figure 1:
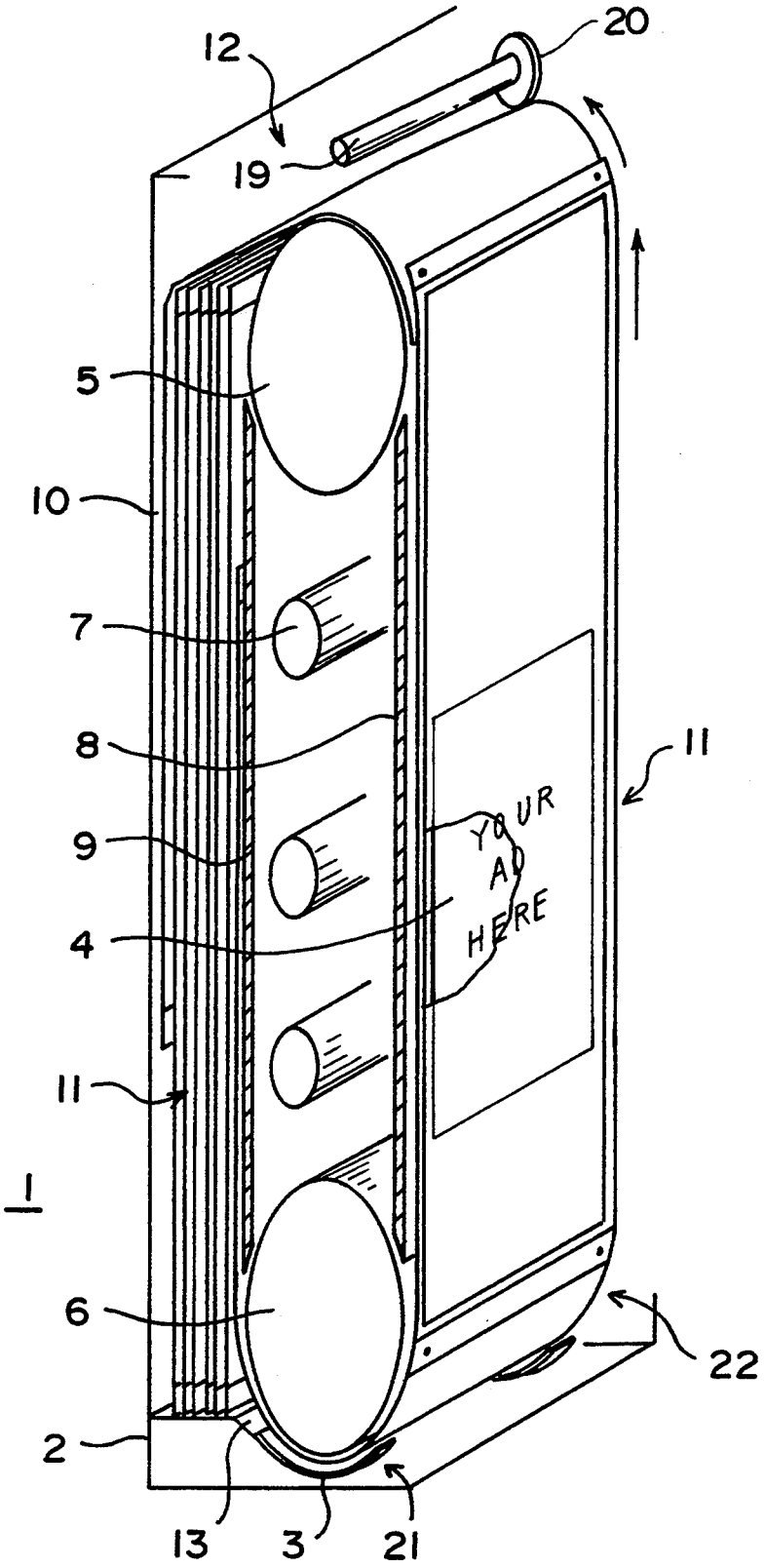
FIG. 1 is a perspective view of a device in accordance with a preferred embodiment of the present invention.

Device 1 is placed in a housing 2. It has two guide rollers 5, 6, placed at a distance from one another, and between which an illumination device 7 is placed in a chamber that is formed with a transparent front guide wall 8 and a rear dividing wall 9. Behind dividing wall 9 is placed a chamber 10 for receiving advertisement carriers 4.

Advertisement carriers 4 can be positioned in front of guide wall 8 by a drive device. Guide wall 8, e.g., can be made of opal acrylic glass. In the area of upper guide roller 5, an intake opening 12 is provided in chamber 10 extending over its width. In the area of lower guide roller 6 chamber 10 has an outlet opening 13 that also extend the width of the chamber. Under guide roller 6 are provided guide pieces 3, which serve to guide advertisement carriers 4 as they are drawn from chamber 10. A drive shaft 19 is provided as drive device, which is placed above upper guide roller 5. One drive disk 20 is placed on each end of drive shaft 19. Drive disks 20 rest on guide roller 5 and convey advertisement carriers 4 passed through between drive disks 20 and guide roller 5.

Advertisements carriers 4 are comprised of poster-like blanks, e.g., made from paper, which in each case is mounted in a pocket 11 that has an open section on one side and is made of a transparent flexible sheet material. The open sections of pockets 11 can be made sealable. For this purpose, clamp closures or closures formed of synthetic materials that adhere when pressed together (I.e., a hook and pile closure of the type sold under the trademark VELCRO) can be provided on the open sections of pockets 11.

Figure 2:
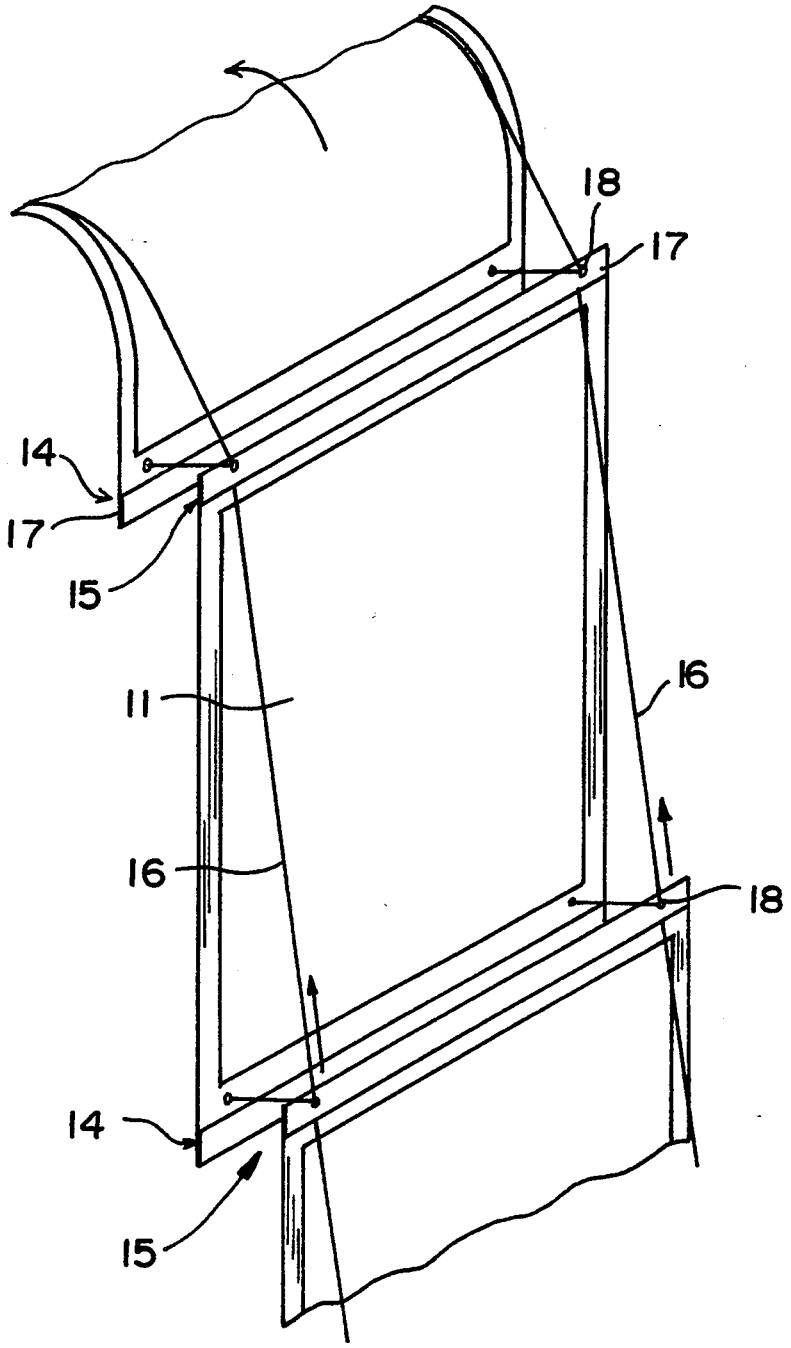

Stiffening strips 17 with holes 18 are placed on end sections 14, 15 of pockets 11 (FIG. 2). Fastening of individual pockets 11 into an endless pocket strip can take place in various ways.

As represented in FIG. 2, it is possible, in each case, to connect each end section 14 of a pocket 11 loosely with an end section 15 of another pocket 11 by a pair of strips 16. In this case, strips 16 are guided through holes 18 of stiffening strip 17 on end section 15 of pocket 11. In this way, pockets 11 are connected to one another so that they can be successively displayed in chamber 10 but at the same time remain part of an endless pocket strip.

Pockets 11 overlap so that when introduced into chamber 10 they are automatically displayed, and the respective last pulled-in pocket 11 rests on rear wall 26 of chamber 10. Drive shaft 19 with drive disks 20, already described above, can serve as the drive device for conveying pockets 11. In this case, drive shaft 19 can be rotated manually and/or by an electric motor. It is also possible to operate the electric motor in a preset timing, so that the desired retention time of advertisement carriers 4 in the visible field of device 1 is guaranteed.

Figure 3:
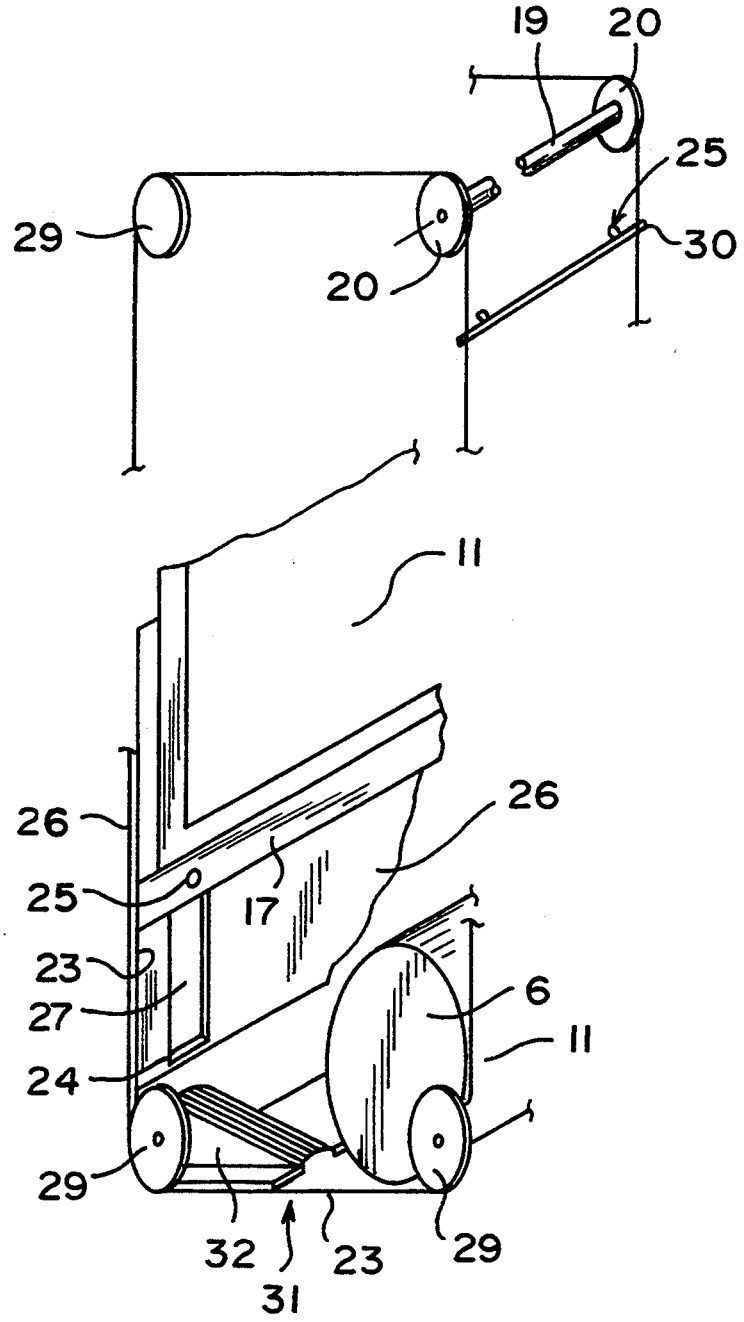

Another drive device for conveying pockets 11 is represented in FIG. 3. This drive device comprises two endless strips 23, one at each of the ends 21, 22 of the guide rollers 5, 6. The endless strips 23 are guided on disks 20 of a common drive shaft 19 and on three pairs of direction changing disks for changing the path of endless strips 23 at each of the corners of the housing. Further sliding wedges 32 are placed on bottom 31 of chamber 10 for guiding pockets 11. They can consist of a polyamide and serve as friction bearings for the pockets 11 as each is drawn from chamber 10.

Horizontal connecting sections 30 are fastened between the two endless strips 23. Hooks 25 are placed on connecting sections 30 and can be engaged with a respective hole 18 of each stiffening strip 17 of the one of the pockets 11 that is resting on dividing wall 9 in chamber 10. Two vertical slots 27 are made in rear wall 26 of chamber 10, each of which serves for a respective guiding hook 25 of an endless strip 23 during pulling of a pocket 11 into chamber 10. Ejection devices 24 are provided on the lower end sections of slots 27, by which hooks 25 are ejected from holes 18 in the stiffening strip 17 of a pocket 11 being pulled into chamber 10. More specifically, ejection devices 24 are downwardly inclined or curved projections which push the stiffening strip 17 away from the respective hook 25. Because the hook is restrained from moving through the slot 27 (because the connecting strip 30 on which it is mounted is on the opposite side of rear wall 26 from pockets 11), it is caused to disengage from the respective opening of stiffening strip 17.

Figure 4:
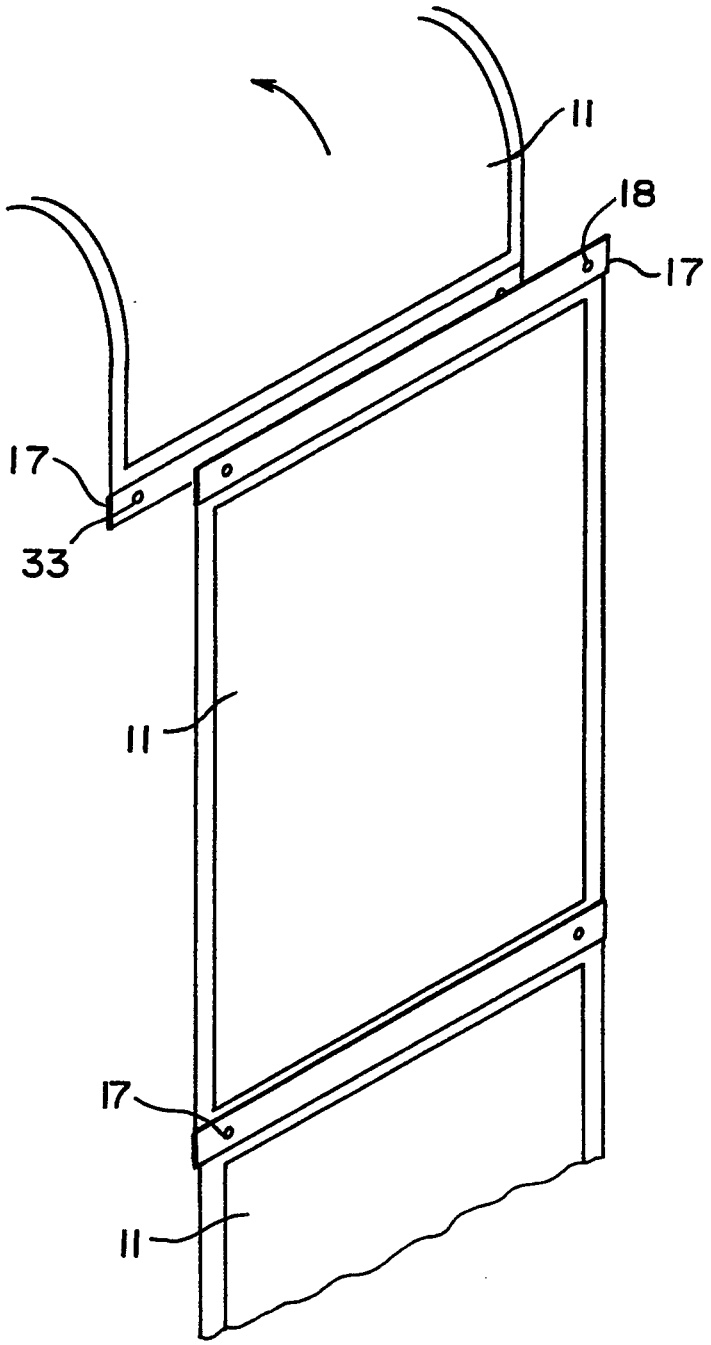

It is also possible to place guide hooks 33 on one stiffening strip 17 of each pocket 11, and to have these hooks engage in a respective hole 18 of a facing stiffening strip 17 of following pocket 11 (FIG. 4).

Figure 5:
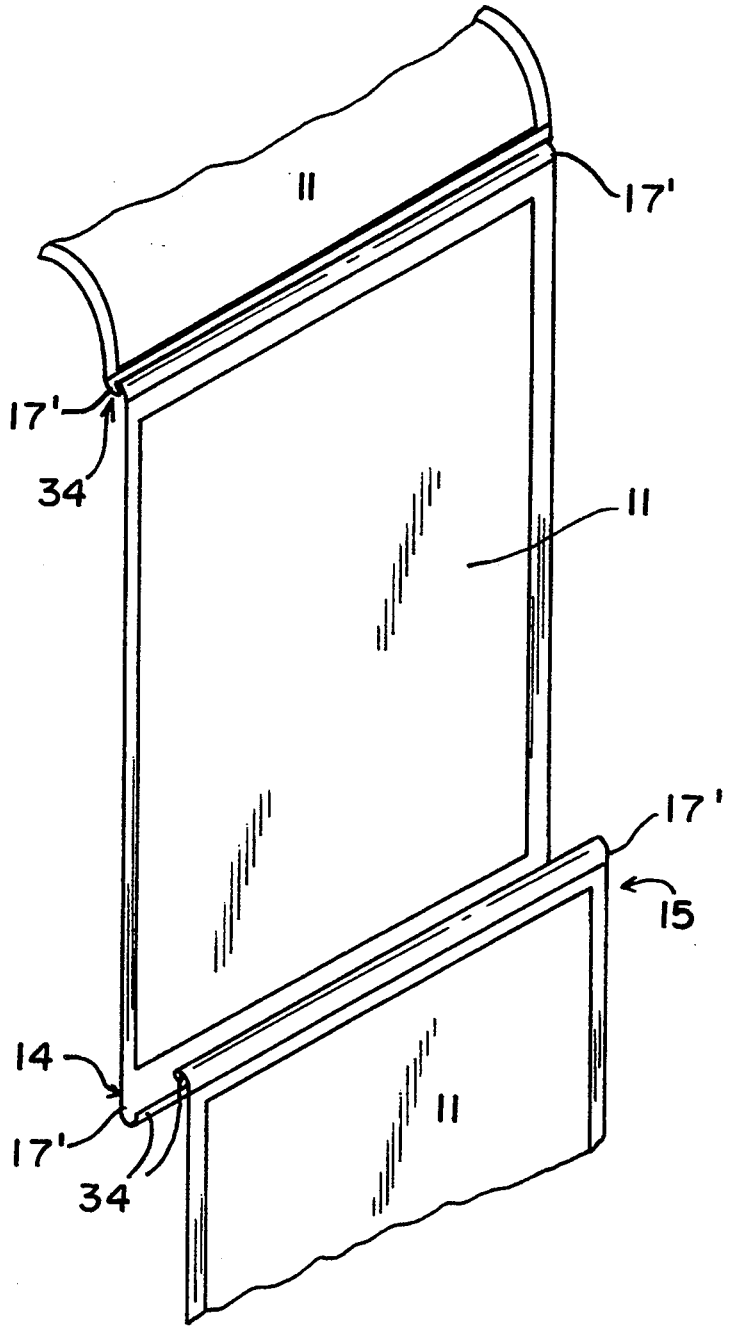

In the embodiment of pockets 11 according to FIG. 5 stiffening strips 17' are placed on the upper and lower end sections 14, 15. These strips 17' are hook-shaped and extend over the width of the pockets 11. For this purpose, the respective free end section of each stiffening strip 17' has a U-shaped or rectangular profile in cross section. The free edge portion of each strip 17' forms a cross strip 34. Cross strips 34 of end sections 14, 15, face one another, so that two pockets 11 can engage in the rear with a respective front pocket 11 pulling a succeeding pocket 11 to the front of guide wall 8 and from there again into chamber 10.

Figure 6:
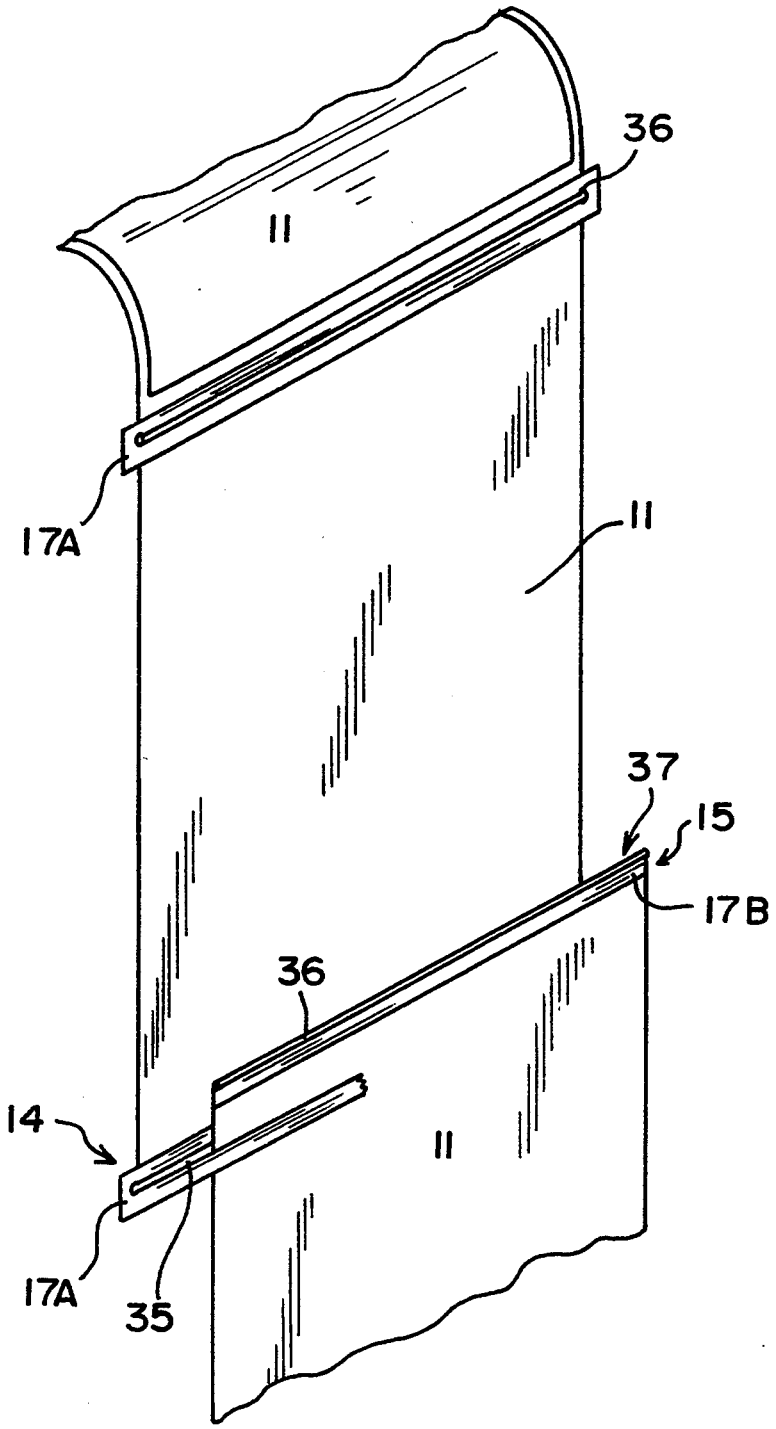

FIG. 6 shows another embodiment of an endless pocket strip, whose individual segments each present a pocket 11. On lower end section 14 of each pocket 11, a slot 35 is made in the stiffening strip 17A that extends over the width of pocket 11. A stiffening strip 17B of the upper end section 15 of the following pocket 11 is guided through this slot 35. On the head side 37, strip 17B is provided with a thickening 36 that extends at least across the width of this stiffening strip 17B, and which prevents it from slipping out of stiffening strip 17A after strip 17B has been threaded through slot 35 of preceding pocket 11. This design of pockets 11 with slots 35 and thickenings 36 makes possible both a hanging together of pockets 11 as an endless strip and the consecutive shoving of pockets 11 into chamber 10. In this way, pockets 11 with advertisement carriers 4 can again be stacked behind one another in chamber 10 but form an endless pocket strip in the successively pulled-apart state.

In the embodiments of pockets 11', represented in FIG. *7a* to *7c*, the pockets 11' can be longitudinally shifted relative to one another without the connection between them being destroyed. To this end, perpendicular slots 38 are made in pockets 11' on each side edge. Knobs 39 are placed on upper stiffening strips 17 each of pocket 11'. The shaft 52 of each knob 39 is guided through a slot 38 of a respective preceding pocket 11, so that disk-shaped knobs 39 engage on the back side of this pocket 11' over the slot 38.

Figure 10:
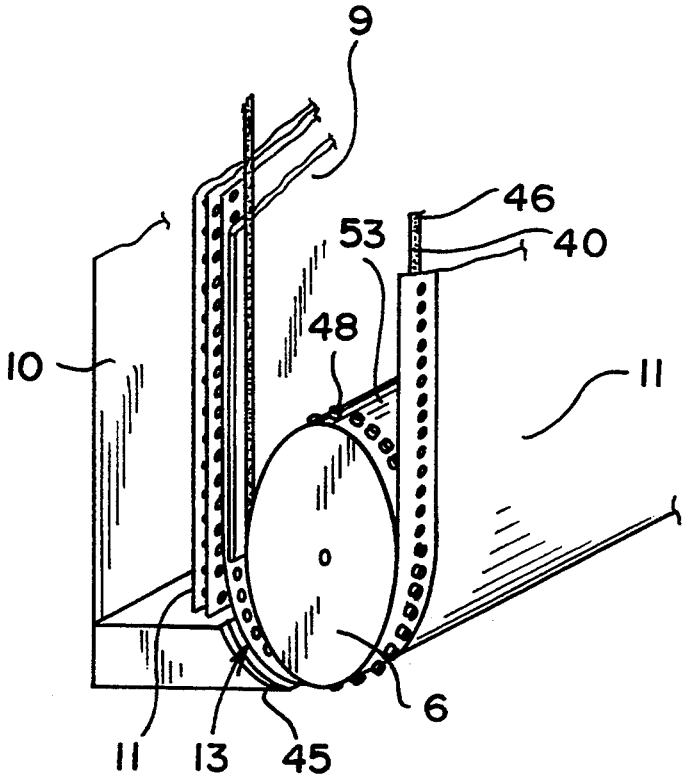

In FIGS. 8 to 10, conveying devices with which pockets 11'', stacked separately in chamber 10, can be conveyed individually in front of guide wall 8 and reconveyed from this position again into chamber 10. Outlet opening 13 of the housing extends over the entire width of chamber 10 and is dimensioned so that, in each case, only one pocket 11'' can be introduced into outlet opening 13. By lateral guides 45 on outlet opening 13 and by its own weight, one pocket 11 each is fed to a conveyor roller arrangement 49.

Conveyor roller arrangement 49, represented in FIG. 8, consists of pairs of rollers 40, 41, which are placed at equal distances on both sides of the visible surface. With these pairs of rollers 40, 41, in each case, roller 40 is driven by means of a central drive shaft 19 by a drive belt or a chain. In the lower area, conveyor roller arrangement 49 is used for guiding a respective pocket 11 in front of guide wall 8, and in the upper area, for guiding pocket 11 into chamber 10. Thus, each pocket 11 is conveyed from roller pair to roller pair into the visible surface and from there again into chamber 10.

As represented in the upper part of FIG. *9a* and in *9b*, the forced guiding of pockets 11 can also be performed if the conveyor roller arrangement 49 uses a gear-like roller 42. In such a case, a vertical line of perforations 44 is provided on each side-of pockets 11. Each pair of rollers 40 consists of a gear-like roller 42 and a counterpressure roller 43. Teeth 51 of inner, gear-like roller 42, which also can be driven centrally by a drive shaft 19, engage through the perforations 44 and in each case rest in a groove-shaped recess 50 formed on the periphery of the related counterpressure roller 43. In this way the engagement of teeth 51 in perforation 44 is assured.

Instead of an arrangement of gears 42 with counterpressure rollers 43, an endless belts 46 can be placed in the area of each edge of the pockets 11 for conveying the pockets 11 and for their forced guidance (FIG. 10). These endless belts 46 are provided on both sides with projecting cams 47. Inside cams 46 engage in hole-like recesses 48 in the periphery of guide roller 6, which serves as a drive shaft. As a result endless belt 46 is driven. Outside cams 47 engage in perforations 44 of pockets 11 and thus convey them into the visible window and from there again into chamber 10.

Figure 11:
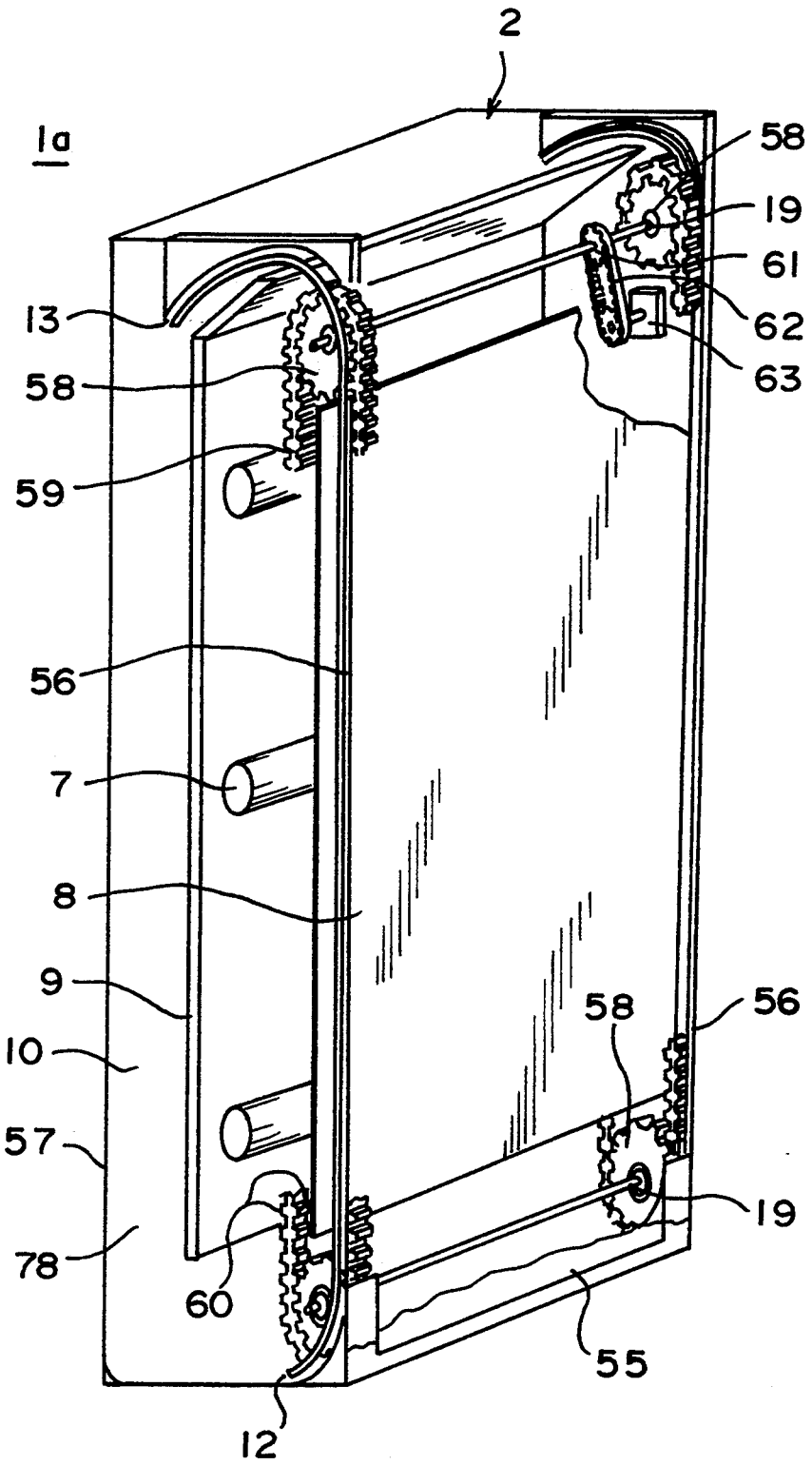
FIG. 11 is a partially broken away perspective view of the device shown in FIG. 1.
Figure 12:
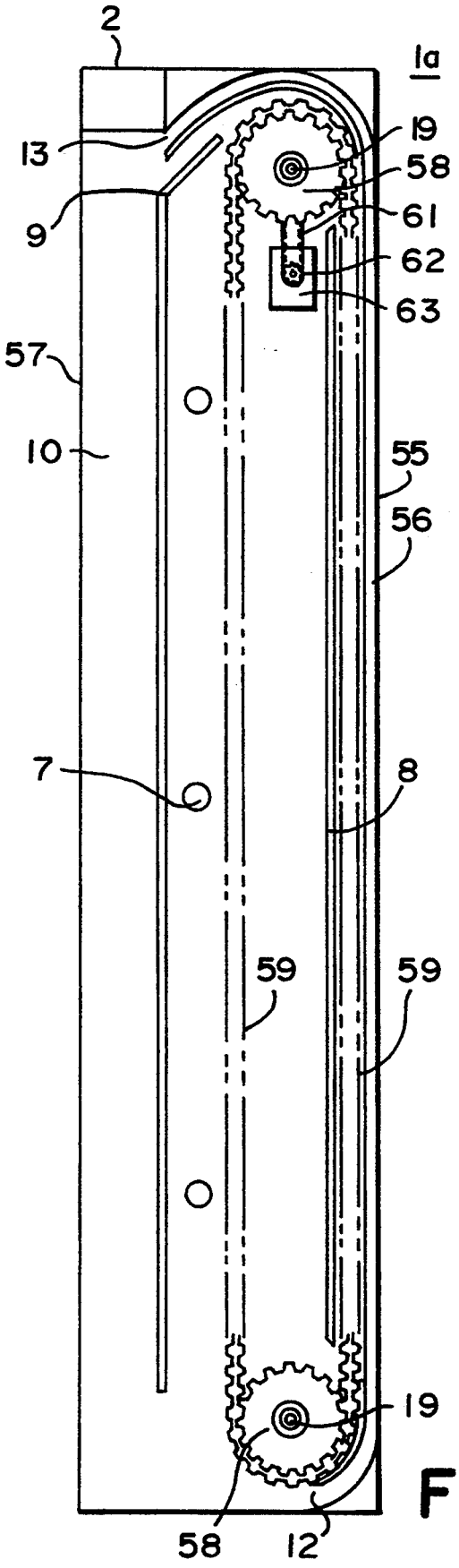
FIG. 12 is the device according to FIG. 1 in a sectional side view.
Figure 13:
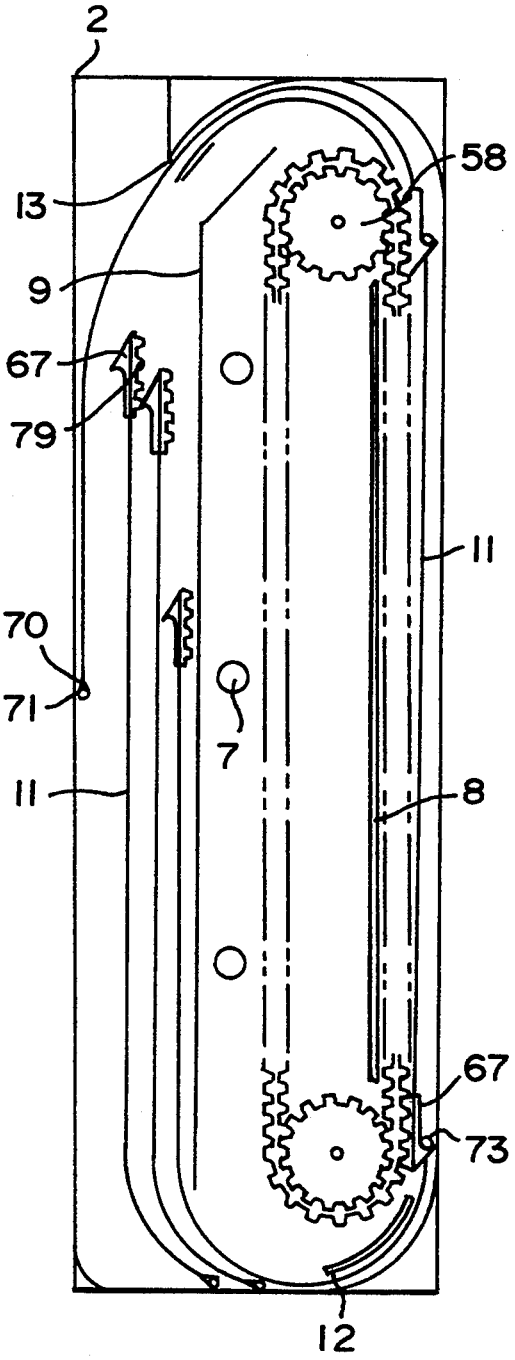
FIG. 13 is the device according to FIG. 1 with the schematically presentation of the function.

Device 1*a* of FIG. 11 comprises a housing 2, the front wall of which is forms a visible area for an advertisement carrier 4 by a transparent glass wall 55. Within the housing 2, a front transparent guide wall 8 and a rear dividing wall 9 is arranged. Between the dividing wall 9 and the guide wall 8, an illumination device 7 is placed in a chamber. The space between dividing wall 9 and back panel 57 forms chamber 10 for receiving advertisement carriers 4, vertically one behind the other. At each side wall 78, one guide rail 56 is arranged close to the glass wall 55. The end sections of rails 56 lead up to the intake opening 12 and the outlet opening 13 of chamber 10. The pockets 11 are guided within the guide rails 56 during transport along the glass wall 55.

At the upper and lower end sections of housing 2, in each case a pair of gears 58 is arranged near the side walls 78. The upper gears 58 are connected to a drive shaft 19. A further gear 61 is connected to the drive shaft 19 and to the drive gear of a driving motor 63 by a toothed belt 62. This driving motor 63 may be for instance an electrical back-geared motor. It is of advantage to actuate the driving motor 63 in clock-controlled timed fashion so that each advertisement carrier 4 will be guided before the glass wall 55 and will rest there for a predetermined dwell time. The lower gears 58 are also connected by a drive shaft 19. Each lower gear 58 is operated by a one-pieced toothed belt 59 that interlocks it with a respective upper gear 58.

The toothed belt 59 may have a double-sided teeth arrangement. In this case the tooth profile of the toothed belt 59 on the side opposite to that which engages the gears 58 is in operative connection to toothed strips 79 that are arranged on the backside of pockets 11 of advertisement carriers 4. These toothed strips 79 may be of one-piece or formed as arrangement of pieces of a toothed belt, and they extend, preferably, over the length of pockets 11 in a direction of advance.

It is even possible to form the backsides of toothed belts 59 to be smooth. In this case, at the backside-of toothed belts 59, clamping bands are brought up which engages with clamping bands on the backside of pockets 11 of advertisement carriers 4 in the region of glass wall 55. Conditional on the restricted guidance o f pockets 11 in the guide rails 56, the toothed belt-strips 79 or clamping bands respectively of pockets 11 are brought compulsorily into engagement with teeth 60 of toothed belts 59 or the clamping bands on toothed belts 59, respectively. Each pocket 11 has a pair of interlocking hooks 67 for engaging the succeeding pocket 11. The interlocking hooks 67 will be described detailed further below.

With reference to FIGS. 14–16, the pockets 11 of advertisement carriers 4 comprise two blanks 65, 66 of a transparent flexible sheeting. The breadth of the rear blank 65 is equal to the distance of guide rails 56 from each other. The forward blank 66 is arranged at the rear blank 65 in such a way that, an edge strip 68, 69 is formed on each side of the rear blank 65 extending in the direction of advance of the pockets 11 (FIG. 15). On the backside of edge strips 68, 69, in each case, a toothed belt-strip 79 or a clamping band is arranged. On the front side of edge strips 68, 69, in the area of one end section 14 of pocket 11, in each case, an interlocking hook 67 is arranged. The interlacing hooks 67 may be connected to the edge strips 68, 69 by rivets or via an adhesive substance.

Each interlocking hook 67 has a base plate 75 for connection with an edge strip 68, 69. On the base plate 75, a holding piece 76 is formed with an open recess 77. The external surface of each holding piece 76 is angularly arranged relative to the plane of base plates 75 to form a wedge-shaped slide-off surface 72 (FIG. 14). By this construction, it is easier to release the connection between the advertisement carrier 4 within the chamber 10 since the edges of the below described jogs 74 of blanks 65 are able to slide down at the angular formed wedge-shaped slide-off surfaces 72.

At end section 15, opposite to end section 14, the blanks 65, 55 are connected by a profile clamping strip 70. A profile rod 71 is led through the profile clamping strip 70 over the breadth of end section 15. The rod tips 73 of profile rod 71 are to be grabbed by the holding pieces 76 in the open recess of the interlocking hooks 67. At the region of each rod tip 73, a jog or notch 74 is made in edge strips 68, 69 to make it easier to detach rod tips 73 of one pocket 11 from the interlocking hooks 67 of a preceding pocket 11 in chamber 10.

The blanks 65, 66 may be connected at the ends by an adhesive band able to be re-picked up. The adhesive band may be of thin transparent material. By this, a pocket 11 is formed into which for instance an advertisement poster or the like may be put in.

For achieving a carrier connection between toothed belt 59 and toothed belt-strips 79 of pockets 11, various different profiles may be applied which guarantee such a carrier connection. What is essential is that, by means of restricted guidance through guide rails 56, the toothed belts 59 are brought in connection with the pocket 11, and after finished transport, an independent separation takes place.

Figure 17:
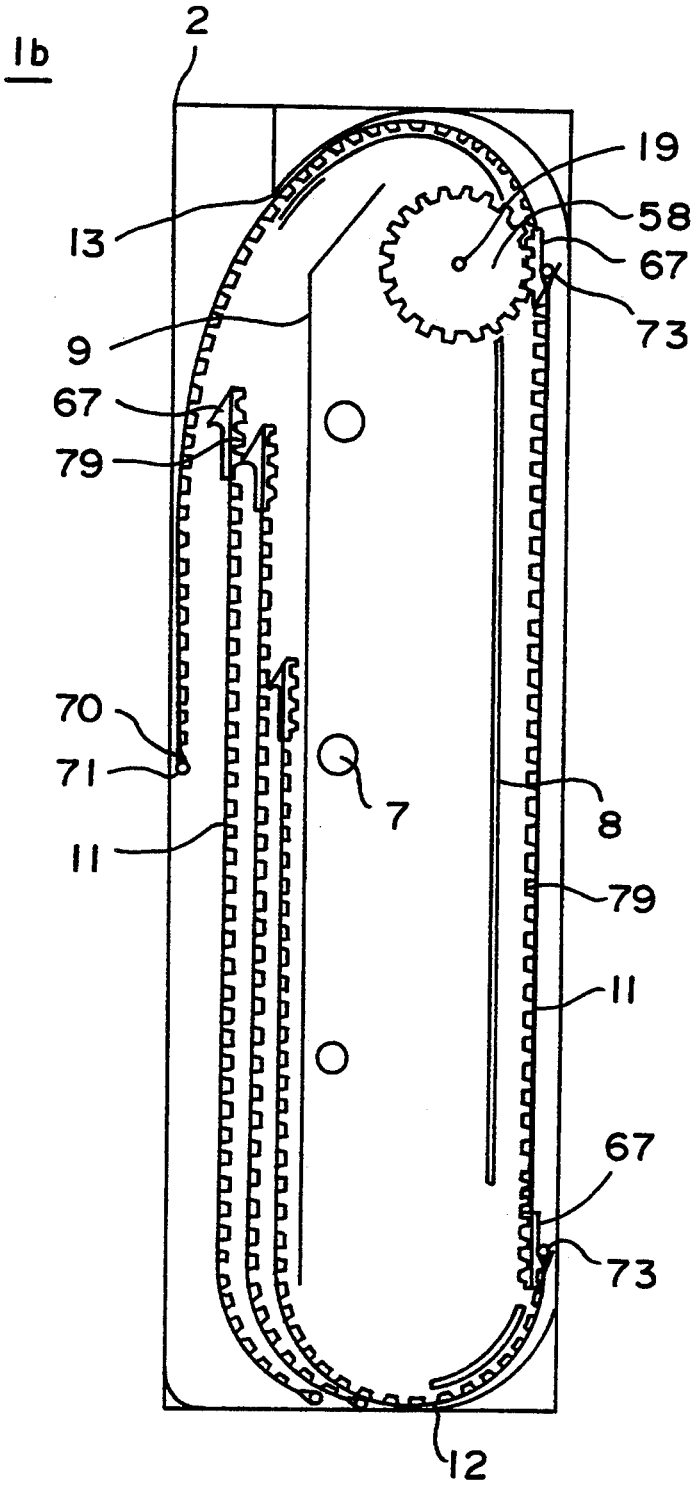
FIG. 17 is a sectional side view a further embodiment of a device in accordance with the present invention.

FIG. 17 shows a device 1*b* for which only the motorized driven upper gears 58 and toothed belt-strips 79 on the backside of edge strips 68, 69 are necessary. The fastening of toothed belt strips 79 on edge strips 68, 69 may be done by bonding agent or rivets. If the blank 65 is made of foil, being transparent and of opal-white color, no front transparent guide wall 8 is necessary. For the function of this device 1*b*, it is necessary that the pockets 11 and the edges are guided by the guide rails 56. At initial operation of the device lb, it is necessary in each case to bring the first pocket 11 into operating connection with gears 58. By rotation of gears 58, then an endless band is formed by pockets 11 in the chamber 10.

We claim:

1. Device for holding a variable number of rear-illuminated advertisement carriers, each of which is a poster-like blank comprising two guide rollers spaced at a distance from one another, an illumination device disposed between the guide rollers, a front transparent guide wall, a rear dividing wall, a chamber for receiving advertisement carriers that is located behind said rear dividing wall, and a drive device for removing an advertisement carrier from said chamber and positioning it in front of said guide wall; wherein a slot-like intake opening and a slot-like outlet opening extend across width of the chamber in an upper and a lower area in proximity to a respectively one of the guide rollers; wherein a number of pockets is provided in each of which a respective advertisement carrier is mounted, each pocket being formed of a transparent flexible sheet having an opening on one side and stiffening strips on opposite end sections of the flexible sheet; and wherein connection means is provided for enabling said pockets to be conveyed by said drive device in an endless series from said chamber, through said outlet opening, into a display position and from said display position back to said chamber via said intake slot, while also enabling a plurality of said pockets to be temporarily contained within said chamber, in successive order, one behind another in a substantially parallel relationship to each other.

2. Device according to claim 1, wherein the opening of each pocket is provided with a closure by which it can be sealed.

3. Device according to claim 1, wherein the closure is one of a clamp and a hook and pile closure.

4. Device according to claim 1, wherein the guide wall is an opal acrylic glass sheet.

5. Device according to claim 1, wherein said connection means comprise endless strips which are guided through holes in the stiffening strips in a manner producing a loosely connected, endless array of successively displayable pockets.

6. Device according to claim 1, wherein the drive device comprises a drive shaft that rests on an upper one of the guide rollers and which is rotatably drivable.

7. Device according to claim 1, wherein the drive device comprises endless strips on each edge of the guide rollers, said endless strips being guided by a common drive shaft and being provided with hooks which are engageable with the stiffening strips of a respective pocket when it rests in the chamber on the dividing wall.

8. Device according to claim 7, wherein the rear wall of the chamber is provide with vertical slots for guiding the hooks during pulling of a pocket into the chamber.

9. Device according to claim 8, wherein an ejection device for ejecting hooks from holes of stiffening strips of the pockets as they are pulled into the chamber is located at a lower end section of the vertical slots.

10. Device according to claim 9, wherein sliding wedges are provided at the bottom of the chamber for guiding pockets being pulled into the chamber.

11. Device according to claim 7, wherein the drive shaft has two drive disks, one for each of the endless strips; wherein a direction change disk is provided in the area of the upper guide roller for each endless strip; and wherein two direction change disks for each endless strip are located in the area of the lower guide roller.

12. Device according to claim 7, wherein the hooks are fastened on horizontal connecting sections which run between the endless strips.

13. Device according to claim 1, wherein guide hooks are disposed on one stiffening strip of each pocket and holes in the other stiffening strip of each pocket, the hooks of the one stiffening strip of each pocket engaging in respective holes of the other stiffening strip of a following pocket as said connection means.

14. Device according to claim 1, wherein the stiffening strip at one end of each pocket has a cross strip formed with a hook-shaped free end section that extends in front of the stiffening strip substantially over the full width thereof; wherein the stiffening strip at the other end of each pocket has a cross strip formed with a hook-shaped free end section that extends at the rear of the stiffening strip substantially over the full width thereof; wherein the hook-shaped free end section in front of the stiffening strip of one pocket is engaged in the hook-shaped free end section at the rear of the stiffening strip of an adjacent pocket as said connection means.

15. Device according to claim 1, wherein the stiffening strip at one end of each pocket has a slot that extends substantially over the full width of the stiffening strip; wherein the stiffening strip at the other end of each pocket is formed with a thickening that extends substantially over the full width of the stiffening strip; wherein the thickening of the stiffening strip of one pocket is engaged in the slot of the stiffening strip of an adjacent pocket as said connection means.

16. Device according to claim 1, wherein a vertical slot extends, generally, from a lower stiffening strip to an upper stiffening strip at an edge side of each pocket; wherein a knob is formed near each end on the upper stiffening strip of each pocket, each knob of one pocket being slideably engaged in a respective slot of an adjacent pocket as said connection means.

17. Device according to claim 1, wherein the drive device comprises a conveyor roller arrangement made of pairs of rollers which are placed on front and back sides of the transparent guide wall at each side of a visible surface area thereof, and a central drive therefor; wherein each pocket is conveyed by contact pressure between the pairs of rollers from the chamber to in front of the guide wall and from there back into the chamber.

18. Device according to claim 17, wherein rollers on one of the front and back sides of the guide wall have teeth which engage with the rollers at the opposite side thereof through a line of perforations formed in the pockets at each side of the visible surface area thereof.

19. Device according to claim 1, wherein at least one of said guide rollers is driven and forms part of said drive device; wherein hole-like recesses are placed in an outer surface of both guide rollers at opposite ends thereof; wherein an endless toothed belt is provided at each end of the driven guide roller, said endless toothed belt having teeth at inner and outer sides thereof, the teeth on the inner side engaging in the hole-like recesses in the driven guide roller and the teeth on the outer side engaging in lines of perforations formed in each pocket at opposite edge areas thereof.

20. Device according to claim 1, wherein the drive device comprises at least one pair of spaced apart rollers, over each roller of which an endless belt is fed, each endless belt being actively engageable with the pockets to be fed to a viewable area of the housing; wherein each roller is formed as a gear which engages at a backside of a pocket of an advertisement carrier; wherein, at a front side of each pocket, at one end section in a direction of advance, at a side border, at least one interlocking hook is arranged which is actively engageable and disengageable with an opposite end section of an adjacent pocket; and wherein guide rails are formed at the side walls of the housing near the viewable area through which the pockets are led to the viewable area.

21. Device according to claim 20, wherein two pairs of rollers are provided, each of which is arranged in sections of the housing opposite to each other, wherein one gear of one pair of rollers is connected to a gear of the other pair of rollers by means of an endless toothed belt.

22. Device according to claim 21, wherein the toothed belts are in disengageable engagement within the backside of a pocket in proximity to the viewable area.

23. Device according to claim 21, wherein the toothed belts have teeth on each side and the tooth profiles opposite to the gears engage toothed belt strips arranged on the backside of the pockets in the area of the transparent guide wall.

24. Device according to claim 23, wherein the toothed belt strips at the backside of the pockets are formed as an arrangement of toothed belt pieces.

25. Device according to claim 24, wherein the toothed belt strips extend in one piece over the length of the pockets in said direction of advance.

26. Device according to claim 20, wherein the end section of guide rails are led to the inlet area and outlet area of the chamber between back panel and rear dividing wall.

27. Device according to claim 20, in which one pair of rollers is motor driven and a common shaft for the rollers is formed as drive shaft; wherein a further gear is mounted on the drive shaft and is connected to a drive gear of a driving motor by a toothed belt.

28. Device according to claim 27, wherein the driving motor is an electric motor.

29. Device according to claim 27, wherein the driving motor has a clock-controlled actuator.

30. Device according to claim 20, wherein each pocket comprises a pair blanks of transparent foil, the breadth of a rear one of the blank being equal to the distance between the guide rails and a front front one of the blanks being arranged on the rear blank in such a manner as to form lateral edge strips on the rear blank that extend in said direction of advance.

31. Device according to claim 30, wherein a toothed belt is mounted on the backside of each edge strip and at least one interlocking hook is arranged at the front side of the edge strips in the area of one end section of each pocket.

32. Device according to claim 31, wherein at the end section of the pocket opposite to the end section with the at least one interlocking hook, the blanks are detachably connected by a profile clamping strip, through which a profile rod is led which extends over the breadth of this end section, said rod having rod tips which in each case are disengageably connected with an interlocking hook as said connection means.

33. Device according to claim 32, wherein, in the area of the rod tips, jogs are formed in the edge strips.

34. Device according to claim 32, wherein each interlocking hook comprises a base plate with an integrated holding piece and an open recess into which a rod tip may be fed.

35. Device according to claim 34, wherein an outer surface of each holding piece is formed as slide-off surface that is angular with respect to a plane of the base plate.

36. Device according to claim 30, wherein on the backside of the edge strips of the rear blanks, toothed belt strips are arranged.

37. Device according to claim 30, wherein the rear blank consists of a transparent foil of opal-white color.

38. Device for holding a variable number of rear-illuminated advertisement carriers, each of which is a poster-like blank comprising two guide rollers spaced at a distance from one another, an illumination device disposed between the guide rollers, a front transparent guide wall, a rear dividing wall, a chamber for receiving advertisement carriers that is located behind said rear dividing wall, and a drive device for removing an advertisement carrier from said chamber and positioning it in front of said guide wall; wherein a slot-like intake opening and a slot-like outlet opening extend across width of the chamber in an upper and a lower area in proximity to a respectively one of the guide rollers; and wherein a pocket is provided in which a respective advertisement carrier is mounted, each pocket being formed of a transparent flexible sheet having an opening on one side and stiffening strips on opposite end sections of the flexible sheet; wherein said pockets are detachably connectable in a manner enabling them to be conveyed in an endless series from said chamber, through said outlet opening, into a display position and from said display position back to said chamber via said intake slot, while also enabling a plurality of said pockets to be temporarily contained within said chamber, in successive order, one behind another in a substantially parallel relationship to each other; and wherein each end section of one pocket is loosely connected with an end section of another pocket by endless strips which are guided through holes in the stiffening strips.

39. Device for holding a variable number of rear-illuminated advertisement carriers, each of which is a poster-like blank comprising two guide rollers spaced at a distance from one another, an illumination device disposed between the guide rollers, a front transparent guide wall, a rear dividing wall, a chamber for receiving advertisement carriers that is located behind said rear dividing wall, and a drive device for removing an advertisement carrier from said chamber and positioning it in front of said guide wall; wherein a slot-like intake opening and a slot-like outlet opening extend across width of the chamber in an upper and a lower area in proximity to a respectively one of the guide rollers; and wherein a pocket is provided in which a respective advertisement carrier is mounted, each pocket being formed of a transparent flexible sheet having an opening on one side and stiffening strips on opposite end sections of the flexible sheet; and wherein each end section of one pocket is loosely connected with an end section of another pocket by endless strips which are guided through holes in the stiffening strips in a manner producing an endless strip of successively displayable pockets.

* * * * *